US006147047A

United States Patent [19]

Robbins et al.

[11] Patent Number: 6,147,047

[45] **Date of Patent: *Nov. 14, 2000**

[54] MICROEMULSION DILUTABLE CLEANER

[75] Inventors: Michael H. Robbins, Pleasanton; Lynn M. Hearn, Livermore; Robert L. Blum, Concord; Angeline B. Edsinger, Pleasanton, all of Calif.

[73] Assignee: The Clorox Company, Oakland, Calif.

[ * ] Notice: This patent is subject to a terminal disclaimer.

[21] Appl. No.: 09/075,805

[22] Filed: May 11, 1998

Related U.S. Application Data

[63] Continuation-in-part of application No. 08/695,384, Aug. 9, 1996, Pat. No. 5,854,187.

[51] Int. Cl.[7] ..... C11D 17/08; C11D 17/00

[52] U.S. Cl. ..... 510/417; 510/365; 510/432; 510/433; 510/475; 510/504; 510/505; 510/506

[58] Field of Search ..... 50/365, 417, 432, 50/433, 475, 505, 504, 506

[56] References Cited

U.S. PATENT DOCUMENTS 3,813,345 5/1974 Urton ..... 252/312

5,691,289 11/1997 Purcell et al. ..... 252/542

*Primary Examiner*—Yogendra Gupta
*Assistant Examiner*—Gregory E. Webb
*Attorney, Agent, or Firm*—Mark E. Baze

[57] ABSTRACT

A concentrated, dilutable cleaning composition is provided which comprises a microemulsion comprising an oil phase of which the "oil" is a nonionic surfactant, a predominant aqueous continuous phase, a polar organic solvent coupling agent, and a combination of surfactants different from the surfactant oil phase as the dispersing agent facilitating formation of said microemulsion, the cleaning composition dilutable with water for use as an all purpose cleaner and characterized by exhibiting the feature of blooming upon such dilution even in the absence of a lipophilic oil (or solvent). The blooming phenomenon is associated with the formation of a liquid crystal dispersion, which liquid crystal state is found to greatly enhance the cleaning effectiveness of the composition. In one aspect of the invention, one of the dispersing agent surfactants is a cationic surfactant which may be a quaternary ammonium compound capable of imparting an antimicrobial effect to the composition.

17 Claims, 2 Drawing Sheets

MICROEMULSION DILUTABLE CLEANER

The present application is a continuation-in-part application of U.S. patent application Ser. No. 08/695,384 filed Aug. 9, 1996, now U.S. Pat. No. 5,854,187 which is hereby incorporated by reference in its entirety.

FIELD OF THE INVENTION

The present invention relates generally to cleaning compositions, and more particularly to a concentrated cleaning composition in the nature of a microemulsion which "blooms" upon dilution with water and yields a form of liquid crystal state and which in one aspect has an antimicrobial capability.

BACKGROUND OF THE INVENTION

Compositions comprising oil-in-water or water-in-oil microemulsions are well known for providing cleaning concentrates which, upon dilution with water, form cleaning formulations having a delivery strength that is easily adjustable by the user. However, the "oil" phase of such microemulsions has consistently been described as, for example, a natural oil, a petroleum distillate (mineral spirit or hydrocarbon), a sparingly soluble organic solvent, or a perfume or fragrance oil, all of which may be categorized as lipophilic oils or solvents. Examples of these microemulsions include the series of patents to Loth et al., U.S. Pat. Nos. 5,075,026, 5,076,954, 5,082,584 and 5,108,643 (perfume); to VanEenam, U.S. Pat. Nos. 5,080,822, 5,080,831, 5,158,710 and 5,419,848 (sparingly soluble organic solvent); to Rosano, U.S. Pat. Nos. 4,146,499 and 4,472,291 (hydrophobic/lipophilic oil or solvent); to Mihelic et al., U.S. Pat. Nos. 5,401,325 and 5,401,326 ((lipophilic) organic solvent); and the single patents to Erilli et al., U.S. Pat. No. 5,393,468 (water insoluble organic compound) and Spaulding et al., U.S. Pat. No. 4,867,898 (pine oil).

Microemulsions of certain compositions may, upon dilution, transform from a clear solution to a solution having a milky color or appearance, as opposed to retention of a clear solution (which may or may not still remain as a microemulsion) or the formation of a mixture having two or more separated phases. This phenomenon is termed in the art as a "bloom" or "blooming. " Such a bloom is most commonly the result of formation of a macroemulsion, but, as will be seen later herein, it may also be due to formation of a dispersed liquid crystalline state. In addition to imparting an aesthetic appearance, the blooming feature signals the user that an appropriate concentration or strength has been attained that is useful for most cleaning applications.

Well known blooming microemulsion compositions are those which, as with the general category of dilutable microemulsions described above, contain a lipophilic oil, in particular pine oil, which is primarily composed of terpenes. Such a lipophilic oil, at least heretofore, has been a necessary constituent to any formulation that is capable of blooming. However, pine oil, for example, imparts at least some underlying pine scent to any composition in which it is employed, thereby limiting the variety of scents or fragrances one might wish a cleaning composition to have.

Described in U.S. Pat. No. 5,591,708, issued to Richter in 1997, is a composition for which it is the stated goal to develop a pine oil type cleaning composition in which the amount of pine oil present in the product is reduced, but which still exhibits one or more of the (favorable) identifying characteristics of pine oil, including a pine scent and a blooming capability, of which the latter is clearly most important for purposes of that patent. Called out as essential elements (in addition to water) for the Richter composition are pine oil (referred to in the patent as "constituent A"), a nonionic surfactant exhibiting a cloud point of 20 C or less ("constituent B"), and a solubilizing agent which may include lower alkyl alcohols and lower alkylene glycols ("constituent C"). Optional constituents include, among others, a nonionic surfactant exhibiting a cloud point of greater than 20 C, and a cationic surfactant in the nature of a germicidal quaternary ammonium compound.

There is no suggestion in Richter that the pine oil constituent might be eliminated entirely and there still be achieved a cleaning composition that is capable of blooming. Indeed, Applicants' own experiments reveal that when the pine oil is removed from a composition otherwise identical to the preferred "E1" formulation given in Richter, the resulting composition does not bloom when diluted with water.

Described in U.S. Pat. No. 5,035,826, issued to Durbut et al. in 1991, is a microemulsion cleaning composition which forms a liquid crystal when diluted with water in an amount not exceeding three parts of water per part of the concentrated composition. While this reference never speaks of a composition which "blooms" per se, one form of the liquid crystal state which occurs upon dilution is variously described in the patent as being "cloudy or milky" or "turbid or lactescent." This would possibly suggest that a bloom may be occurring when the composition of that reference is diluted.

The necessary constituents (in addition to water) of the Durbut invention are a mixture of nonionic and ionic surfactants, a cosurfactant which is preferably a monoalkyl ether of a lower glycol or polyalkylene glycol, and a lipophilic organic solvent which is preferably a hydrocarbon. The nonionic surfactant component is most preferably a mixture of a larger amount of a nonionic surfactant which is more hydrophilic, and a smaller amount of a nonionic surfactant which is less hydrophilic. The ionic surfactant component may be either anionic or cationic, the latter including quaternary ammonium compounds.

Again, there is no teaching, disclosure or suggestion in Durbut that the lipophilic solvent should be eliminated entirely and there be achieved a cleaning composition that is still capable of blooming. Indeed, the phase diagrams depicted in that patent indicate that when the composition of that patent has zero paraffin (i.e., zero lipophile), there is no liquid crystal formation, and thus presumably no bloom.

The compositions of Richter and Durbut are both but further examples of microemulsion compositions of the type in which a conventional lipophilic oil or solvent is employed for the oil phase.

Thus, there is believed to be no prior art which teaches, discloses or suggests that one can form a cleaning concentrate comprising an oil-in-water type of microemulsion without a conventional lipophilic oil or solvent also being present. It follows from the foregoing that it is also believed that there is no prior art which teaches, discloses or suggests that one can form a microemulsion concentrate capable of blooming upon dilution with water without a conventional lipophilic oil or solvent also being present.

SUMMARY OF THE INVENTION

Accordingly, it is an object of the present invention to provide a microemulsion concentrated cleaner capable of dilution for use as an all purpose cleaner.

It is another object of the present invention to provide a microemulsion cleaner which uses a sparingly soluble to water insoluble nonionic surfactant as the oil phase as opposed to a conventional or non-surfactant lipophilic oil or solvent.

It is a further object of the present invention to provide a microemulsion cleaner that forms a milky bloom upon dilution with an appropriate amount of water.

It is yet another object of the present invention to provide a microemulsion cleaner that forms a dispersed liquid crystal state upon dilution with an appropriate amount of water.

It is yet a further object of the present invention to provide a microemulsion cleaner which avoids or greatly limits the use of odoriferous solvents, such as fragrance oils, terpenes and tertiary alcohols, as the oil phase.

It is still another object of the present invention to provide a microemulsion cleaner which in one aspect is capable of an antimicrobial effect.

It is still a further object of the present of the invention to provide a microemulsion cleaner which is stable and capable of blooming at a wide range of temperatures.

Briefly, the present invention is directed to a concentrated cleaning composition in the form of a microemulsion capable of dilution for use as an all purpose cleaner. The cleaning composition in one aspect comprises an oil phase in which a sparingly soluble to water insoluble nonionic surfactant is used as the "oil" of the oil phase, a predominant aqueous continuous phase, a polar organic solvent coupling agent, and a combination of surfactants different from the surfactant oil phase as the dispersing agent which facilitate formation of the microemulsion.

Upon dilution of the composition with an appropriate amount of water, the mixture exhibits the milky blooming phenomenon traditionally associated with pine oil cleaners, but yet the bloom is able to occur in the absence of pine oil or any other lipophilic oil or solvent such as has been traditionally employed for formulation of microemulsions generally and of cleaning compositions capable of blooming in particular. The blooming phenomenon of the inventive composition is associated with the formation of a liquid crystal dispersion, which liquid crystal state is found to greatly enhance the cleaning effectiveness of the composition.

In a further aspect of the invention, one of the dispersing agent surfactants is a cationic surfactant which may be a quaternary ammonium compound capable of imparting an antimicrobial effect to the composition.

It is an advantage that the inventive cleaning composition is able to bloom in the absence of any lipophilic oil or solvent.

It is another advantage that the cleaning composition can be formulated to have a wide variety of fragrance smells.

It is a further advantage that the cleaning composition provides an enhanced cleaning performance versus a microemulsion cleaner having a solvent as the oil phase.

DETAILED DESCRIPTION OF THE INVENTION

Figure 1:
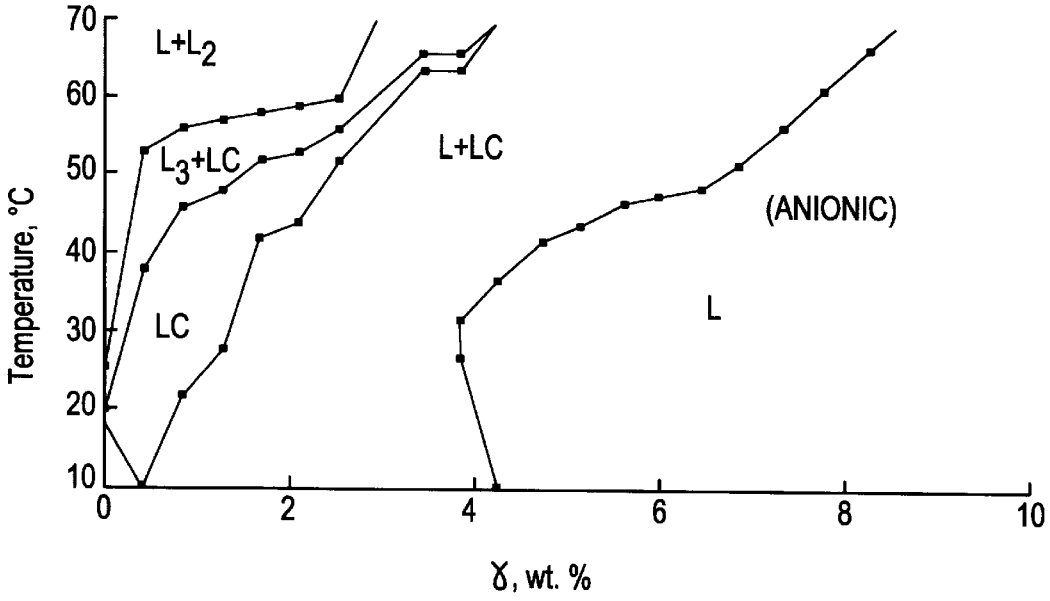
FIG. 1 is a phase diagram showing the solution behavior of a formulation according to the inventive composition wherein the dispersing agent includes an anionic surfactant.

The invention provides a concentrated, cleaning composition which comprises a microemulsion comprising an oil phase of which the "oil" is a nonionic surfactant, a predominant aqueous continuous phase, a polar organic solvent coupling agent, and a combination of surfactants different from the surfactant oil phase as the dispersing agent facilitating formation of said microemulsion, the cleaning composition dilutable with water for use as an all purpose cleaner and characterized by exhibiting the feature of blooming upon such dilution even in the absence of a lipophilic oil (or solvent). As used herein, the expression "lipophilic oil" does not include compounds which are commonly referred to as surfactants or detergents, although such compounds may, of course, exhibit lipophilic characteristics overall.

In the invention, the microemulsion is defined as a liquid system in which a sparingly soluble to water insoluble oil phase is dispersed within a continuous liquid phase, which here, is the predominant aqueous phase. In order to form, and maintain, the microemulsion, a dispersing agent is required, which here, is a combination of at least two surfactants which differ from the sparingly soluble to water insoluble nonionic surfactant employed as the "oil" of the oil phase. The dispersing agent is preferably a combination of an ionic surfactant and a (different) nonionic surfactant. Further, a coupling agent which is a polar organic solvent is employed to attain appropriate stability of the microemulsion.

The microemulsions of the invention are thermodynamically and temperature stable liquid systems. They are transparent to somewhat translucent at room temperature and are isotropic. They are formed by the gentle admixture of the ingredients and do not require shearing or other addition of energy. They also do not require any special order of addition of ingredients.

Because a nonionic surfactant is used as the oil phase, the inventive microemulsions are more versatile than microemulsions with solvent-based oil phase microemulsions, as the inventive microemulsions more readily disperse or solubilize fragrance oils, or other sparingly soluble materials, without the need of hydrotropes or other dispersants. Also, because employment of odoriferous lipophilic materials (such as pine oil) can be avoided and there still be achieved a composition capable of forming a microemulsion and, moreover, of blooming, the compositions can be made to exhibit a greater variety of smells.

The novel microemulsions of this invention generally contain a higher actives level than is usually necessary for all purpose cleaning, such as the cleaning of various hard surfaces (countertops, floors, walls, tables, etc.). Thus, the formulations of the invention are alternatively referred to as "concentrates" which are diluted with appropriate amounts of water for use. It is an aesthetic and practical advantage of the inventive microemulsions that, upon attaining a certain use dilution, the microemulsions produce a bloom in the dilution medium. This signals the user that the appropriate concentration or strength (actives level) has been attained for effective cleaning, with minimal residue. Generally speaking, the level of dilution water to microemulsion varies from about 128:1 to 10:1, more preferably about 64:1 to about 10:1, in order to achieve the formation of the bloom.

It has been ascertained that the bloom which is afforded by the preferred inventive compositions upon their dilution with water is in the nature of a dispersion of liquid crystals (please see the Experimental section, below, and associated phase diagrams as shown in the Figures) and not a macroemulsion, which is characteristic of blooming, lipophilic oil-containing (usually pine oil-containing) concentrates. These liquid crystals are brightly illuminated under cross-polarized lenses and can be lamellar, hexagonal, or cubic in structure. That a liquid crystalline state is achieved at a consumer-usable temperature and relatively low surfactant concentration is believed to be due, at least in part, to the presence of an ionic surfactant constituent. Formation of such liquid crystalline material results in greater cleaning efficacy as compared to formation of a macroemulsion, retention of a microemulsion, or formation of some other state (again, please see the Experimental section, below, and associated Figure).

Standard, additional adjuncts in small amounts such as fragrances, dyes, and the like can be included to provide desirable attributes of such adjuncts.

In the application, effective amounts are generally those amounts listed as the ranges or levels of ingredients in the descriptions which follow here to. Unless otherwise noted, amounts listed in percentage ("%'s") are in weight percent of the composition.

1. The Oil Phase Nonionic Surfactant

The crux of the invention lies in the use of a nonionic surfactant as the "oil" phase of the invention instead of a lipophilic oil/solvent. The nonionic surfactant (or surfactants) used is preferably a sparingly soluble to water insoluble nonionic surfactant having a hydrophilic-lipophilic balance ("HLB") of less than about 10, more preferably less than about 8. For a further discussion of HLB measurements, one should consult Popiel, Introduction to Colloid Science (1978), pp. 43–44, and Gerhartz, Ullmann's Encyclopedia of Industrial Chemistry, 5th Ed., Vol. A9 (1985), pp. 322–23, both of which are incorporated by reference herein.

The nonionic surfactants are preferably selected from the classes of linear and branched higher alkoxylated alcohols and alkoxylated alkylphenols. The alkoxylated alcohols may include ethoxylated, propoxylated, and ethoxylated and propoxylated $C_{5-20}$ alcohols, with about 1–5 moles of ethylene oxide, or about 1–5 moles of propylene oxide, or 1–5 and 1–5 moles of ethylene oxide and propylene oxide, respectively, per mole of alcohol, with the selection of the alkoxylated alcohol being preferably determined according to an HLB value of less than about 10, more preferably less than about 8 (a linear alkanol/alcohol ethoxylate is sometimes referred to as an "LAE"). There are a wide variety of exemplary products from numerous manufacturers, such as the Neodol series from Texaco Chemical Co., e.g., Neodol 25-3, a linear $C_{12-15}$ alcohol ethoxylate with 3 moles of ethylene oxide ("EO") per mole of alcohol, HLB of 7.8, and Neodol 91-2.5, a linear $C_{9-11}$ alcohol ethoxylate with 2.5 moles of EO; Alfonic 1412-40, a $C_{12-14}$ ethoxylated alcohol with 3 moles of EO from Conoco; Surfonic L12-2.6, a $C_{10-12}$ ethoxylated alcohol with 3 moles of EO, and Surfonic L24-3, a $C_{12-14}$ ethoxylated alcohol with 3 moles of EO from Huntsman Chemical; and Tergitol 25-L-3, a $C_{12-15}$ ethoxylated alcohol with 3 moles of EO, from Union Carbide. The secondary ethoxylated alcohols may include Tergitol 15-S-3, a $C_{11-15}$ secondary ethoxylated alcohol, with 3 moles of EO, from Union Carbide. The branched surfactants, especially preferred of which are tridecyl ethers, may include Trycol TDA-3, a tridecyl ether with 3 moles of EO, from Henkel KGaA (formerly, Emery), and Macol TD 3, a tridecyl ether with 3 moles of EO, from PPG Industries.

The sparingly soluble nonionic surfactant can also be selected from alkoxylated alkylphenols, such as: Macol NP-4, an ethoxylated nonylphenol with 4 moles of EO, and an HLB of 8.8, from PPG; Triton N-57, an ethoxylated nonylphenol with an HLB of 10.0, Triton N-42, an ethoxylated nonylphenol with an HLB of 9.1, both from Rohm & Haas Co.; and Igepal CO-520, with an HLB of 10.0, an ethoxylated nonylphenol from GAF Chemicals Corp.; Alkasurf NP-5, with an HLB of 10.0, and Alkasurf NP-4, with an HLB of 9.0, both of which are ethoxylated nonylphenols from Alkaril Chemicals; Surfonic N-40, with an HLB of 8.9, an ethoxylated nonylphenol from Huntsman.

Of course, a mixture of two or more such nonionic surfactants preferably having an HLB of less than about 10 may be incorporated into the inventive compositions. Other known nonionic surfactants and other classes of nonionic surfactants not particularly enumerated here may also be used. Such exemplary surfactants are described, for example, in *McCutcheon's Emulsifiers and Detergents* (1997), the contents of which are hereby incorporated by reference.

The amount of the nonionic surfactant comprising the oil phase is preferably in the range of about 0.1% to about 25%, and more preferably, about 3% to 15%.

2. The Coupling Agent—Solvent

The solvent coupling agent is generally a water soluble or dispersible organic solvent having a vapor pressure of at least 0.001 mm Hg at 25° C. It is preferably selected from $C_{1-6}$ alkanols, $C_{1-6}$ diols, $C_{1-6}$ alkyl ethers of alkylene glycols and polyalkylene glycols, and mixtures thereof. The alkanol can be selected from methanol, ethanol, n-propanol, "isopropanol," the various positional isomers of butanol, pentanol, and hexanol, and mixtures of the foregoing. It may also be possible to utilize in addition to, or in place of, said alkanols, the diols such as methylene, ethylene, propylene and butylene glycols, and mixtures thereof, and including polyalkylene glycols.

It is preferred to use a straight or branched chain alkanol as the coupling agent of the invention. These are methanol, ethanol, n-propanol, isopropanol, and the various positional isomers of butanol, pentanol, and hexanol. Especially preferred is isopropyl alcohol ("IPA"), also known as 2-propanol and, in the vernacular, "isopropanol."

One can also use an alkylene glycol ether solvent in this invention. The alkylene glycol ether solvents are typically in addition to the polar alkanol solvent. These can include, for example, monoalkylene glycol ethers such as ethylene glycol monopropyl ether, ethylene glycol mono-n-butyl ether, propylene glycol monopropyl ether, and propylene glycol mono-n-butyl ether, and polyalkylene glycol ethers such as diethylene glycol monoethyl or monopropyl or monobutyl ether, di- or tri-polypropylene glycol monomethyl or monoethyl or monopropyl or monobutyl ether, etc., and mixtures thereof. Preferred glycol ethers are diethylene glycol monobutyl ether, also known as 2-(2-butoxyethoxy) ethanol, sold as Butyl Carbitol by Union Carbide, ethylene glycol monobutyl ether, also known as butoxyethanol, sold as Butyl Cellosolve also by Union Carbide, and also sold by Dow Chemical Co., and propylene glycol monopropyl ether, available from a variety of sources. Another preferred alkylene glycol ether is propylene glycol t-butyl ether, which is commercially sold as Arcosolve PTB, by Arco Chemical Co. Dipropylene glycol n-butyl ether ("DPNB") is also preferred.

It is preferred to limit the total amount of solvent to preferably no more than about 25%, and more preferably, no more than about 15%, of the cleaner. A particularly preferred range is about 1–15%. If any of these organic solvents has a solubility of less than 25% in water (at room temperature, 21° C.), then the amount of such limited water solubility solvents should not exceed about 5%, with the amount of water soluble solvents (such as IPA) then raised to an amount sufficient to maintain the microemulsion. These amounts of solvents are generally referred to as dispersion-effective or solubilizing effective amounts. The solvents, especially the glycol ethers, are also important as cleaning materials on their own, helping to loosen and solubilize greasy or oily soils for easy removal from the surface cleaned.

3. Dispersing Agent—Surfactant Blend

The dispersing agent for the novel microemulsions of the invention is a combination of surfactants different from the oil phase nonionic surfactant. Preferably, it is a combination of an anionic or cationic surfactant and a nonionic surfactant which has an HLB above about 10. The anionic surfactants may generally include, for example, those compounds having an hydrophobic group of C6–C22 (e.g., alkyl, alkylaryl, alkenyl, acyl, long chain hydroxyalkyl, etc.) and at least one water-solubilizing group selected from the group of sulfonate, sulfate, and carboxylate. Preferred are a linear or branched C6–14 alkane sulfonate, alkyl benzene sulfonate, alkyl sulfate, or generally, a sulfated or sulfonated C6–14 surfactant. Examples of these surfactants include Witconate NAS, a 1-octane sulfonate available from Witco Chemical Company; Pilot L-45, a C11.5 alkylbenzene sulfonate (referred to as "LAS") from Pilot Chemical Co.; Biosoft S100 and S130, non-neutralized linear alkylbenzene sulfonic acids (referred to as "HLAS"), and S40, also an LAS, all from Stepan Company; and sodium dodecyl and lauryl sulfates. The more preferred anionic surfactant is an acidic HLAS, such as BioSoft S100 or S130, which is neutralized in situ with an alkaline material such as NaOH, KOH, $K_2CO_3$ or $Na_2CO_3$, with more soluble salts being desirable. These acidic surfactants have a higher actives level and are cost-effective.

Preferable among cationic surfactants, but without limitation thereto, are the quaternary ammonium compounds and salts thereof. Such compounds, sometimes referred to as "quats," are often capable of imparting a broad spectrum antimicrobial or germicidal effect to a cleaning composition. Generally these compounds will have at least one higher molecular weight group and two or three lower molecular weight groups linked to a common, positively charged nitrogen atom. An electrically balancing anion will typically be a halide, acetate, nitrite or lower alkosulfate. The anions may include, for example, bromide, methosulfate, or, most commonly, chloride. The higher molecular weight or hydrophobic substituent(s) on the nitrogen will often be a higher alkyl group, containing from about 6–30 carbon atoms. The remaining lower molecular weight substituents will generally contain no more than a total of 12 carbon atoms and may be, for example, lower alkyls of 1 to 4 carbon atoms, such as methyl and ethyl, which may be substituted, e.g., with hydroxy. One or more of any of the substituents may include or may be replaced by an aryl moiety such as benzyl or phenyl. Many variations of such cationic surfactants are possible, as will be apparent to those skilled in the art.

Exemplary classes of quaternary ammonium salts include the alkyl ammonium halides such as lauryl trimethyl ammonium chloride and dilauryl dimethyl ammonium chloride, and alkyl aryl ammonium halides such as octadecyl dimethyl benzyl ammonium bromide, and the like. Preferred materials with specific sources include didecyl dimethyl ammonium chloride, available as BTC 1010 from Stepan Chemical Co., as BARDAC® 2250 from Lonza, Inc., as FMB 210-15 from Huntington, and as Maquat 4450-E from Mason; dialkyl dimethyl ammonium chloride, available as BTC 818, BARDAC® 2050, Inc., FMB 302, and Maquat 40, each from the source as previously correlated; and alkyl dimethyl benzyl ammonium chloride, available as BTC 835, BARQUAT® MB-50 (from Lonza, Inc.), FMB 451-5, and MC 1412 (from Mason).

Such quaternary germicides are often sold as mixtures of two or more different quaternaries. Non-limiting examples of such suitable preferred mixtures include the twin chain blend/alkyl benzyl ammonium chloride compounds available as BARDAC® 205M and BARDAC® 208M from Lonza, Inc., as BTC 885 and BTC 888 from Stepan Chemical Co., as FMB 504 and FMB 504-8 from Huntington, and as MQ 615M and MQ 624M from Mason.

In addition to the aforementioned class of quaternary ammonium compounds, other suitable cationic surfactants to be used herein include derivatives of phosphonium, imidazolium and sulfonium compounds.

The nonionic surfactant component of the dispersing agent, like the oil phase nonionic surfactant, is preferably chosen from an alkoxylated alcohol and/or alkoxylated alkylphenol but has a higher HLB value than the surfactant "oil." Representative alkoxylated alcohols include Alfonic surfactants, sold by Conoco, such as Alfonic 1412-60, a $C_{12-14}$ ethoxylated alcohol with 7 moles of EO; Neodol surfactants, sold by Shell Chemical Company, such as Neodol 25-7, a $C_{12-15}$ ethoxylated alcohol with 7 moles of EO, Neodol 45-7, a $C_{14-15}$ ethoxylated alcohol with 7 moles of EO, Neodol 23-5, a linear $C_{12-13}$ alcohol ethoxylate with 5 moles of EO, HLB of 10.7; Surfonic surfactants, sold by Huntsman Chemical Company, such as Surfonic L12-6, a $C_{10-12}$ ethoxylated alcohol with 6 moles of EO and Surfonic L24-7, a $C_{12-14}$ ethoxylated alcohol with 7 moles of EO; Tergitol surfactants, sold by Union Carbide, such as Tergitol 25-L-7, a $C_{12-15}$ ethoxylated alcohol with 7 moles of EO.

Representative alkoxylated alkylphenols include Macol NP-6, an ethoxylated nonylphenol with 6 moles of EO, and an HLB of 10.8, Macol NP-9.5, an ethoxylated nonylphenol with about 11 moles EO and an HLB of 14.2, and Macol NP-9.5, an ethoxylated nonylphenol with about 9.5 moles EO and an HLB of 13.0, all sold by Mazer Chemicals, Inc.; Triton N-101, an ethoxylated nonylphenol with 9–10 moles of EO and HLB of 13.4, and Triton N-111, an ethoxylated nonylphenol with an HLB of 13.8, both from Rohm & Haas Co.; Igepal CO-530, with an HLB of 10.8, Igepal CO-730, with an HLB of 15.0, Igepal CO-720, with an HLB of 14.2, Igepal CO-710, with an HLB of 13.6, Igepal CO-660, with an HLB of 13.2, Igepal CO-620, with an HLB of 12.6, and Igepal CO-610 with an HLB of 12.2, all polyethoxylated nonylphenols from GAF Chemicals Corp.; Alkasurf NP-6, with an HLB of 11.0, Alkasurf NP-15, with an HLB of 15, Alkasurf NP-12, with an HLB of 13.9, Alkasurf NP-11, with an HLB of 13.8, Alkasurf NP-10, with an HLB of 13.5, Alkasurf NP-9, with an HLB of 13.4, and Alkasurf NP-8, with an HLB of 12.0, all polyethoxylated nonylphenols from Alkaril Chemicals; and Surfonic N-60, with an HLB of 10.9, Surfonic N-120, with an HLB of 14.1, Surfonic N-102, with an HLB of 13.5, Surfonic N-100, with an HLB of 13.3, Surfonic N-95, with an HLB of 12.9, and Surfonic N-85, with an HLB of 12.4, all polyethoxylated nonylphenols from Huntsman.

The amount of the ionic surfactant is generally between about 0.01 to about 5%, while the (second) nonionic surfactant should be present at between preferably about 0.05–10%, and generally, less than the oil phase nonionic surfactant. On the other hand, the ratio between the total nonionic surfactants (including the oil phase nonionic surfactant) and the ionic surfactant preferably should be at least greater than 1:1, more preferably between about 15:1 to 1:1.

4. Water

Since the cleaner is an aqueous cleaner with relatively low levels of actives, the principal ingredient is water, which should be present at a level of at least about 60%, more preferably at least about 70%, and most preferably, at least about 80%. Deionized water is preferred. Water forms the predominant, continuous phase in which the oil phase nonionic surfactant is dispersed.

5. Miscellaneous Adjuncts

Small amounts of adjuncts can be added for improving aesthetic qualities of the invention. Aesthetic adjuncts include fragrances or perfumes, such as those available from Givaudan-Rohre, International Flavors and Fragrances, Quest, Sozio, Firmenich, Draoco, Norda, Bush Boake and Allen and others, and dyes or colorants which can be solubilized or suspended in the formulation. Because the microemulsions are clear, colorless liquids, a wide variety of dyes or colorants can be used to impart an aesthetically and commercially pleasing appearance. Also, advantageously, the fragrance oils do not require a dispersant since the oil phase nonionic surfactant will act to disperse limited solubility oils. However, unlike, for example, the Loth et al. patents, the fragrance oils do not comprise the majority of the oil phase and are not a necessary constituent. This is further advantageous since these aesthetic materials tend to be expensive, so limiting their amount is cost-sparing, and they typically do not add to (and, in fact, may detract from) cleaning performance. The amounts of these aesthetic adjuncts should be in the range of 0–2%, more preferably 0–1%.

Additionally, because the surfactants in liquid systems are sometimes subject to attack from microorganisms, it is advantageous to add a mildewstat or bacteristat. Exemplary mildewstats (including non-isothiazolone compounds) include Kathon GC, a 5-chloro-2-methyl-4-isothiazolin-3-one, Kathon ICP, a 2-methyl-4-isothiazolin-3-one, and a blend thereof, and Kathon 886, a 5-chloro-2-methyl-4-isothiazolin-3-one, all available from Rohm and Haas Company; Bronopol, a 2-bromo-2-nitropropane 1,3-diol, from Boots Company Ltd.; Proxel CRL, a propyl-p-hydroxybenzoate, from ICI PLC; Nipasol M, an o-phenylphenol, $Na^+$ salt, from Nipa Laboratories Ltd.; Dowicide A, a 1,2-benzoisothiazolin-3-one, from Dow Chemical Co.; and Irgasan DP 200, a 2,4,4'-trichloro-2-hydroxydiphenylether, from Ciba-Geigy A.G. See also, Lewis et al., U.S. Pat. No. 4,252,694 and U.S. Pat. No. 4,105,431, incorporated herein by reference.

It is generally preferred to avoid adjuncts which would result in the suspension of particles in the microemulsion, for example, salts (such as NaCl, $Na_2SO_4$), builders, electrolytes, enzymes, pigments, and the like. This particulate matter may disrupt the microemulsion and reduce the clarity of the resulting product.

In the following Experimental section, the surprising performance benefits of the inventive blooming microemulsion cleaner are demonstrated.

EXPERIMENTAL

In Table I below, a base formulation is disclosed which may include either an anionic or cationic surfactant as indicated:

TABLE I

| Wt. % | Ingredient | Manufacturer |
|---|---|---|
| 1.0% | $C_{10-12}$ LAS or | Stepan Biosoft S100 |
| | Alkyl dimethyl benzyl quat. | Stepan BTC 835 |
| 6.5% | $C_{10-12}$ alc. ethox (2.6 EO) | Huntsman Surfonic L12-2.6 |
| 5.5% | $C_{10-12}$ alc. ethox (6 EO) | Huntsman Surfonic L12-6 |
| 5.0% | IPA | |
| 2.5% | DPNB | Union Carbide |
| q.s. to 100% | D.I. $H_2O$ | |

The above ingredients were assembled and gently admixed, without intensive or extensive shearing. The resulting microemulsions, when prepared with either the anionic or cationic surfactant listed, were clear, one phase and stable at room temperature (21. 1° C.).

Figure 2:
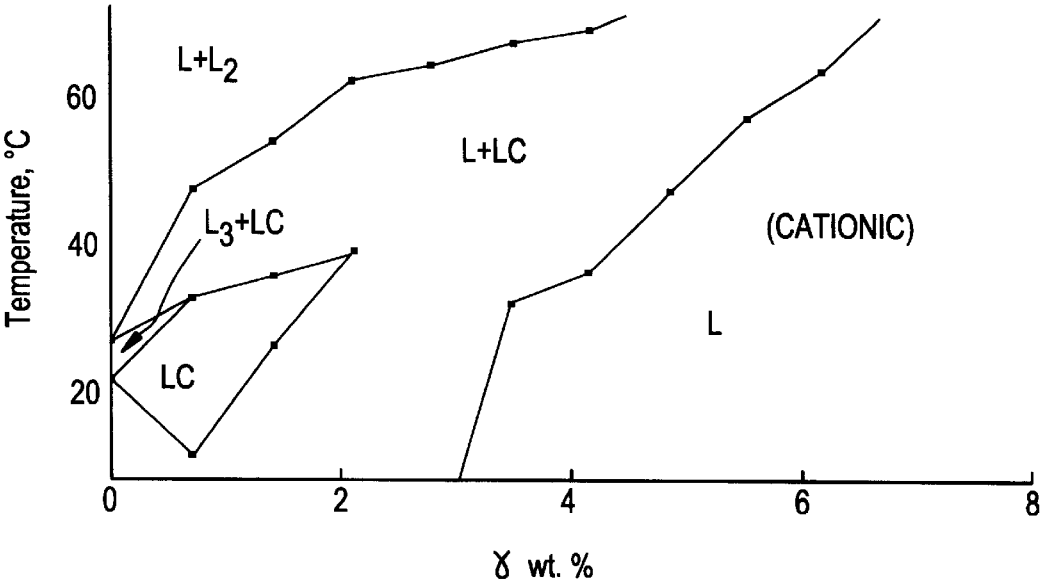
FIG. 2 is a phase diagram showing the solution behavior of a formulation according to the inventive composition wherein the dispersing agent includes a cationic surfactant.
Figure 3:
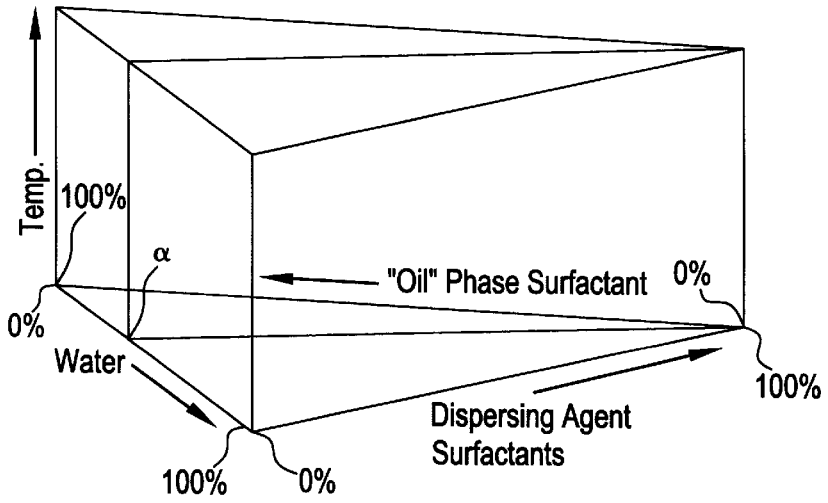
FIG. 3 is a generic representation for assisting with the interpretation of the phase diagrams of FIGS. 1 and 2.

Shown in FIGS. 1 and 2 are phase diagrams of the compositions of Table I for each of the anionic and cationic surfactant-containing compositions, respectively. The phase diagrams were constructed according to the methodology outlined by Kalweit in *Langmuir*, Vol 4 (1988), p. 499, and represent cross-sectional slices, as generically exemplified in FIG. 3, of a prism having a base with sides corresponding to ranges of 0 wt % to 100 wt % for each of (a) the "oil" surfactant (i.e., the linear alcohol ethoxylate with 2.6 moles EO), (b) "water" (includes the IPA and glycol ether), and (c) the combination of dispersing agent surfactants (i.e., the LAS or quaternary ammonium salt and the linear alcohol ethoxylate with 6 moles EO), with the height of the prism as varying temperature. The character "$\alpha$" in FIG. 3 refers to the ratio of "oil" surfactant to "oil" surfactant plus water. The planar "slice" for each of phase diagrams of FIGS. 1 and 2 has been taken at an $\alpha$ of 0.075. In FIGS. 1 and 2, the character "$\gamma$" refers to the ratio of dispersing surfactants to dispersing surfactants plus "oil" surfactant plus water.

The two phase diagrams of FIGS. 1 and 2 indicate that each of the anionic and cationic surfactant-containing compositions exhibit quite similar solution behavior. Moving from right to left in either of those diagrams (and also out of the plane of the page as necessitated by FIG. 3)—as the composition is diluted with water, one initially begins in a phase denoted as "L," which is a clear isotropic solution. Further dilution with water causes entry into a phase denoted as "L+LC," which represents a dispersion of liquid crystalline material and has been determined to be responsible for the milky bloom that occurs. (Note: The singular "LC" phase shown, which represents a pure (clear) liquid crystalline state, is probably not actually seen during dilution; "$L_2$" refers to a surfactant rich phase which occurs when nonionic surfactants are heated and can be described as aqueous droplets in an oil-continuous phase, i.e., a phase inversion occurs; and "$L_3$" refers to a disordered lamellar liquid crystal phase.) The phase diagrams show that the compositions exhibit a blooming capability over a wide temperature range.

Figure 4:
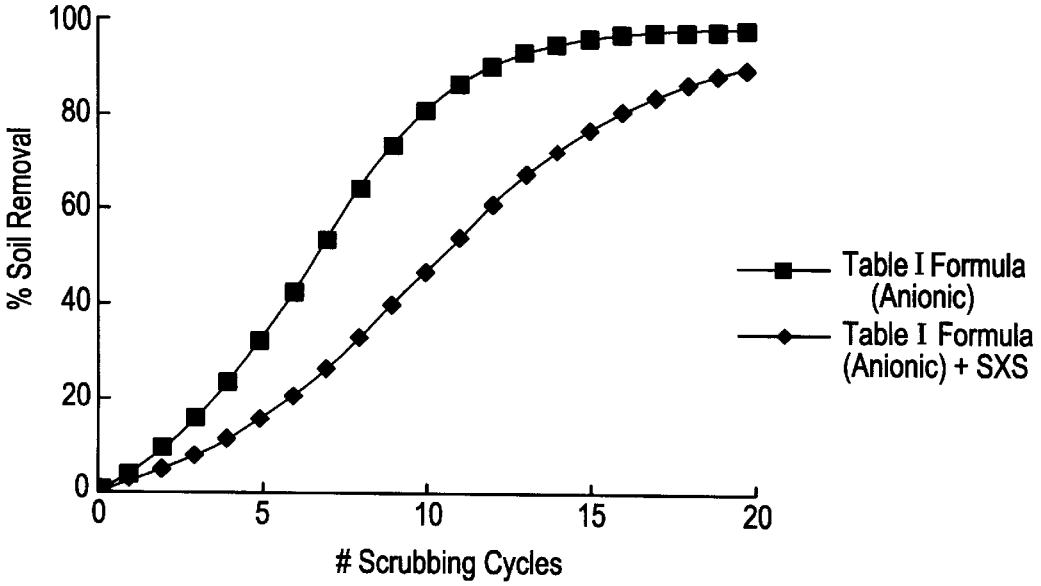
FIG. 4 is a graphical depiction of the soil removing performances of an anionic surfactant-containing formulation according to the inventive composition as compared to the same formulation compromised with a hydrotrope.

That the formation of the dispersed liquid crystalline phase is important for cleaning performance is revealed in FIG. 4. In that Figure, the soil removal cleaning ability of the anionic formula of Table I is compared with the identical formula to which sodium xylene sulfonate ("SXS"), a hydrotrope, has been added. Upon 1:64 dilution of both compositions with water, in the composition containing the SXS, the SXS acts to break up and prevent liquid crystal formation, whereupon a markedly decreased soil removal ability is seen as adjudged by the increased number of scrubbing cycles necessary to remove the same amount of soil versus the uncompromised formulation. The foregoing demonstrates that the formation of the liquid crystal dispersion provides an increased cleaning performance. (The methodology for the testing was to employ a proprietary fabricated soil of an oily/particulate blend, with scrubbing similar to that afforded by a Gardner Abrasion Tester.)

In other tests below, the temperature stability, formation of a bloom and cleaning performance against standard cleaners is demonstrated for the anionic surfactant-containing composition of Table I.

EXAMPLE

Temperature Stability Studies

The formulation of Table I (with anionic surfactant) was challenged at various temperatures in order to determine the stability of the novel microemulsions. In constant temperature rooms, the products were challenged at temperatures of 1.7° C. (35° F.), 21. 1° C. (70° F.), 37.8° C. (100° F.) and 48.8° C. (120° F.) Data pulls took place at 2 weeks, 4 weeks, and 8 weeks for 1.7° C., 21.1° C., 37.8° C. and 48.8° C.; further data pulls took place at 3 months and 6 months for 1.7° C., 21.1° C. and 37.8° C. At all times and temperatures, the product appeared clear and uncloudy. Additionally, the product formulated as in Table I was subjected to three freeze-thaw cycles and, after appropriate resting from the freeze conditions, similarly appeared clear and uncloudy.

In the following Table II, the formulation of Table I (with anionic surfactant) was compared for bloom formation against five commercial microemulsion cleaner products, which were all diluted in accordance with the manufacturer's requirements to the recommended use level (typically, at 1:64 product: water dilution). A panel of expert visual graders graded the bloom formation on a 0 to 5 scale, with 0 being no bloom, 5 being completely opaque. Thus, the higher the averaged grade, the better. The results are depicted in Table II:

TABLE II

| | Bloom Characteristics | | | |
|---|---|---|---|---|
| | Bloom Characteristic Observed (Visually) | | | |
| Product | 10° C. | 21.1° C. | 37.8° C. | 59.9° C. |
| Formula of Table I (Anionic) | 3 | 4 | 4 | 5 |
| Institutional Pine-Sol ®[1,2] | 0 | 2 | 3 | 5 |
| Pine-Sol ®[1,3] | 0 | 0 | 1 | 4 |
| Lysol ® Pine Action[4] | 0 | 0 | 0 | 0 |
| Xtra Pine[5] | 0 | 0 | 0 | 0 |
| Scotch Pine[6] | 0 | 0 | 0 | 0 |

[1]The Clorox Company
[2]Data is for a formulation containing 19% pine oil; the product has since been reformulated to contain 15% pine oil.
[3]Contains 15% pine oil.
[4]Reckitt & Colman
[5]White Cap
[6]Canton Industries As can be seen from the above data, the inventive formulation consistently produced a bloom, regardless of temperature of the dilution medium (water).

In the next set of experiments, the cleaning performance of the novel microemulsion cleaner of Table I (with anionic surfactant) was compared against some commercial microemulsion cleaners. The three sets of tests were for kitchen grease #1 (a proprietary fabricated soil containing unsaturated and saturated animal fats and particulate soil), Sanders & Lambert Floor Soil, and Bathroom Soil (ASTM). The first two tests were conducted on plastic laminated panels, while the Bathroom Soil test was conducted on ceramic tiles. The soiled panels and the soiled tiles were each tested with a Gardner Abrasion Tester whose reciprocating arm was loaded with a moist sponge containing 15 ml. of diluted product (diluted per the manufacturer's use directions). The panels and tiles received 25 strokes of the sponge. A panel of expert graders was again utilized to grade the cleaned panels and tiles, now using a 1 to 10 scale, in which 1 was no soil removal and 10 was complete soil removal. Thus, the higher the averaged grade, the better. The results are depicted in Table III:

TABLE III

| | Cleaning Performance | | |
|---|---|---|---|
| | Soil Removal under Recommended Use Dilutions | | |
| Product | Kitchen Grease #1 | Sanders & Lambert Soil | Bathroom Soil |
| Formula of Table I (Anionic) | 6.3 | 7.47 | 7.13 |
| Pine-Sol ® | 6.67 | 6.8 | 6.18 |
| Lysol ® Pine Action | 2.55 | 5.85 | 4.67 |
| Xtra Pine | 3.07 | 4.12 | 4.02 |
| Lemon Fresh Pine-Sol ®[1] | 4.07 | 4.9 | 4.55 |
| LSD | 1.79 | 0.83 | 0.85 |

[1]The Clorox Company

As can be seen from the foregoing data, the inventive microemulsion, in use dilution, provided superior cleaning performance against most of the commercial microemulsions.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A concentrated, dilutable cleaning composition which comprises a microemulsion comprising a nonionic surfactant oil phase having an HLB of less than about 10, a predominant, aqueous continuous phase, a polar organic solvent coupling agent, and a combination of a cationic surfactant and a surfactant different from the surfactant oil phase as the dispersing agent facilitating formation of said microemulsion, said cleaning composition characterized by exhibiting the feature of blooming upon dilution with water even in the absence of a lipophilic oil.

2. The cleaning composition of claim 1 wherein said nonionic surfactant oil phase is selected from the group consisting of alkoxylated alcohols and alkoxylated alkylphenols.

3. The cleaning composition of claim 1 wherein said different surfactant is a nonionic surfactant having an HLB of greater than 10.

4. The cleaning composition of claim 1 wherein said cationic surfactant is a quaternary ammonium compound.

5. The cleaning composition of claim 4 wherein the quaternary compound is selected from the group consisting of alkyl ammonium halides and alkyl aryl ammonium halides.

6. The cleaning composition of claim 1 which further comprises at least one nonessential adjunct selected from the group consisting of fragrances, dyes, colorants, mildewstats and bacteristats.

7. A concentrated, dilutable cleaning composition of a clear microemulson comprising:

a. an oil phase consisting essentially of a nonionic surfactant having an HLB of less than about 10, said nonionic surfactant oil phase dispersed in a predominant, aqueous continuous phase;

b. at least one polar organic solvent coupling agent; and c. at least two additional surfactants different from the surfactant of said oil phase, said additional surfactants including at least one cationic surfactant and being the dispersing agent facilitating formation of said microemulsion.

8. The cleaning composition of claim 7 wherein said cleaning composition is characterized by exhibiting the feature of blooming upon dilution with water even in the absence of a lipophilic oil.

9. The cleaning composition of claim 7 wherein the nonionic surfactant is selected from the group consisting of alkoxylated alcohols and alkoxylated alkylphenols.

10. The cleaning composition of claim 7 wherein said at least one polar organic solvent comprises a first such solvent selected from the group consisting of $C_{1-6}$ alkanols and $C_{1-6}$ diols, and a second such solvent of a polar glycol ether.

11. The cleaning composition of claim 7 wherein the cationic surfactant is a quaternary ammonium compound.

12. The cleaning composition of claim 7 wherein said additional surfactants include a nonionic surfactant.

13. The cleaning composition of claim 7 which further comprises at least one nonessential adjunct selected from the group consisting of fragrances, dyes, colorants, mildewstats and bacteristats.

14. A concentrated, dilutable cleaning composition of a clear microemulsion comprising:

a. at least about 60% wt. water, said water being part of a predominant aqueous continuous phase;

b. about 0.1–25% wt. of a first nonionic surfactant with an HLB of less than about 10, said first nonionic surfactant effectively constituting a sparingly soluble to essentially water insoluble nonionic surfactant oil phase;

c. about 0.01–5% wt. of a cationic surfactant;

d. about 0.05–10% wt. of a second nonionic surfactant having an HLB of greater than 10, the ratio of the total of the first and second nonionic surfactants to the cationic surfactant at least greater than 1:1, the cationic surfactant and the second nonionic surfactant being a dispersing agent for the first nonionic surfactant oil phase; and e. about 0–25% of a coupling agent comprising a polar organic solvent, said cleaning composition characterized by exhibiting the feature of blooming upon dilution with water even in the absence of a lipophilic oil.

15. The cleaning composition of claim 14 wherein at least one of said first and second nonionic surfactants is selected from the group consisting of alkoxylated alcohols and alkoxylated alkylphenols.

16. The cleaning composition of claim 14 wherein said polar organic solvent is selected from the group consisting of $C_{1-6}$ alkanols, $C_{1-6}$ diols, polar glycol ethers, and mixtures thereof.

17. The cleaning composition of claim 14 which further comprises at least one nonessential adjunct selected from the group consisting of fragrances, dyes, colorants, mildewstats and bacteristats.

* * * * *